US005720701A

United States Patent [19]

Truini

[11] Patent Number: 5,720,701

[45] Date of Patent: Feb. 24, 1998

[54] PORTABLE FITNESS DEVICE FOR DEVELOPING THE ARMS AND UPPER BODY

[76] Inventor: Stefano A. Truini, 285 Central Park West, New York, N.Y. 10024

[21] Appl. No.: 729,582

[22] Filed: Oct. 11, 1996

[51] Int. Cl.[6] ..... A63B 21/02

[52] U.S. Cl. ..... 482/126; 482/122

[58] Field of Search ..... 482/121, 122, 482/125, 126

[56] References Cited

U.S. PATENT DOCUMENTS

| | | | |
|---|---|---|---|
| 4,268,032 | 5/1981 | Cusi | 482/126 |
| 4,861,022 | 8/1989 | Boatcallie | 482/126 |
| 5,496,245 | 3/1996 | Du Verney | 482/126 |

FOREIGN PATENT DOCUMENTS

| | | | |
|---|---|---|---|
| 1428827 | 11/1968 | Germany | 482/126 |

*Primary Examiner*—Lynne A. Reichard

[57] ABSTRACT

A hand held exercising device for developing muscles of the arms and upper body thereof composed of two rigid arms pivotally connected at a point between their respective ends each possessing retaining devices on both sides of the pivotal point to which resilient elements may be attached or removed from, such that depending on the placement of attachment of said resilient elements to the rigid arms and the amount of resilient element attached, the direction of resistance and the magnitude of resistance of the angular movement of the two rigid arms relative to each other may be altered.

8 Claims, 7 Drawing Sheets

PORTABLE FITNESS DEVICE FOR DEVELOPING THE ARMS AND UPPER BODY

BACKGROUND OF THE INVENTION

This invention relates to portable fitness devices designed for exercising and developing muscles of the arms and upper body by providing that movement of the parts of said device can be made to resist muscular effort.

DESCRIPTION OF THE BACKGROUND ART

At present several exercise devices of the portable type which use resilient elements to resist muscular force in order to develop muscles of the arms and upper body exist, notably:

U.S. Pat. No. 5,496,245; Du Verney; March 1996

U.S. Pat. No. 4,629,186; Aldridge; December 1986

U.S. Pat. No. 4,483,533; Mangiapane; November 1984

U.S. Pat. No. 3,349,621; Mullen; October 1967

U.S. Pat. No. 2,529,347; Mohler et. al.; November 1950

These devices all incorporate a lightweight portable structure for upper body muscle development but lack sufficient versatility in combining the variety of exercises that can be performed, the degrees of resistance that can be chosen and the ease with which the degrees of resistance can be changed.

SUMMARY OF THE INVENTION

The current invention comprehends an exercising device for developing the musculature system of the arms and upper body by employing two graspable extensions pivotally connected to each other in a scissor-like manner, whereby the two arms can be further connected with resilient elements. As so attached and connected the opening or closing of these extensions by the muscles of the arm can be met with a full range of degrees of resistance. The device is designed to be lightweight and portable and because of its particular structure permits a wide variety of exercises to be performed.

DETAILED DESCRIPTION OF THE DRAWINGS

Figure 1:
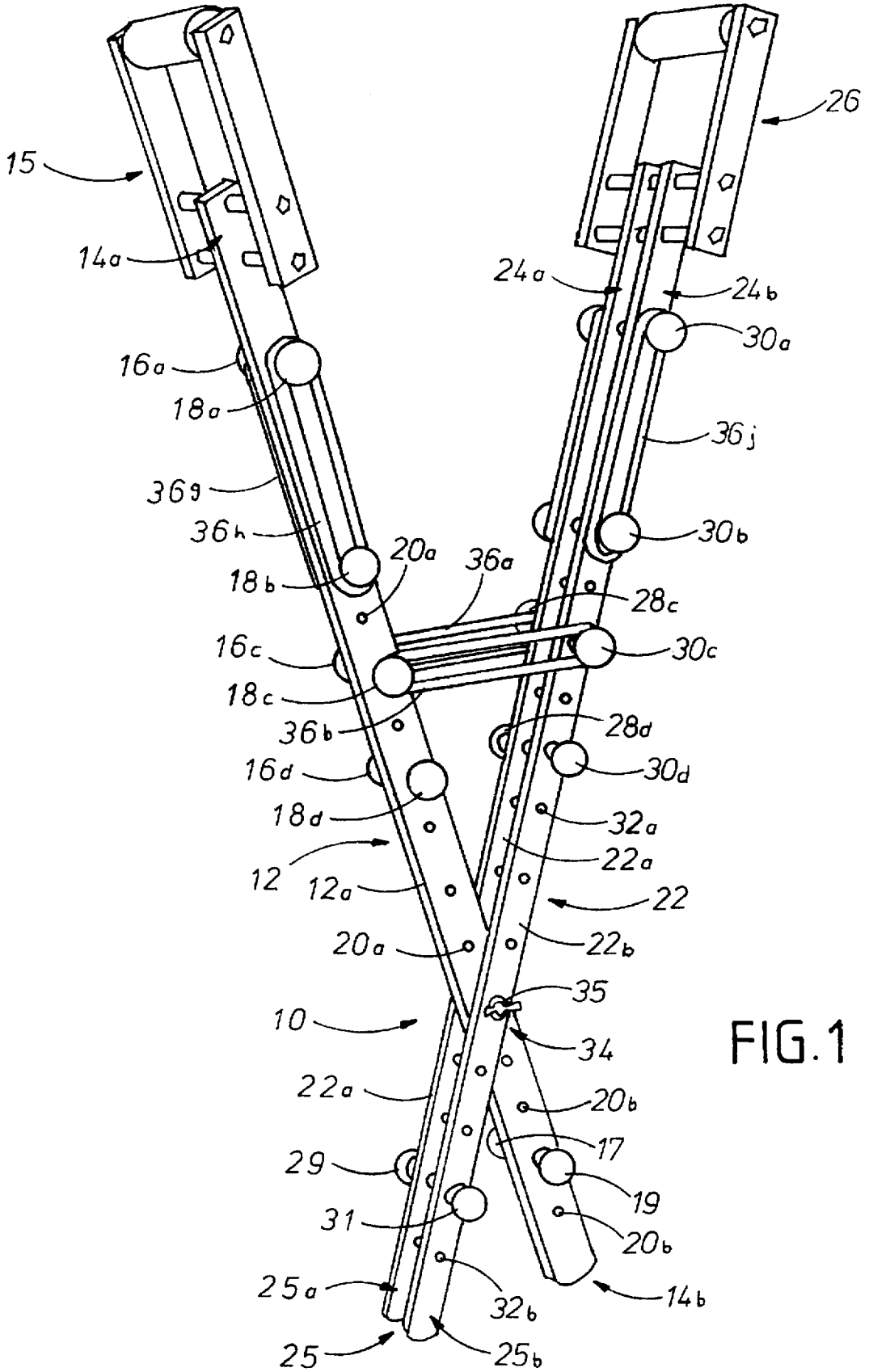
FIG. 1 is a perspective view of the exercising device in a contracted position.

The device illustrated in FIG. 1 is composed of:

10) the exercising device (represented here in a contracted position);

12) the first arm means;

12*a*) the one length of the first arm means 12;

14*a*) the first end of length 12*a;*

14*b*) the second end of length 12*a;*

15) a grip assembly at the first end 14*a;*

16*a–d*) retaining devices on the first side of the first arm means 12 between the first end 14*a* and the pivotal point 34;

17) a retaining device on the first side of the first arm means 12 between the second end 14*b* and the pivotal point 34;

28*a–d*) retaining devices on the second side of the first arm means 12 between the first end 14*a* and the pivotal point 34;

19) a retaining device on the second side of the first arm means 12 between the second end 14*b* and the pivotal point 34;

20*a*) an aperture between the first end 14*a* and the pivotal point 34 to which a retaining device 16, 18, can be coupled to or uncoupled from;

20*b*) an aperture between the second end 14*b* and the pivotal point 34 to which a retaining device 17, 19 can be coupled to or uncoupled from;

22) the second arm means;

22*a*) the first length of the second arm means 22;

22*b*) the second length of the second arm means 22;

24) the first end of the second arm means 22;

24*a*) the first end of length 22*a;*

24*b*) the first end of length 22*b;*

25) the second end of the second arm means 22;

25*a*) the second end of length 22*a;*

25*b*) the second end of length 22*b;*

26) a grip assembly at the first end 24;

28*a–d*) retaining devices on length 22*a* between the first end 24*a* and the pivotal point 34;

29) a retaining device on length 22*a* between the second end 25*a* and the pivotal point 34;

30*a–d*) retaining devices on length 22*b* between the first end 24*b* and the pivotal point 34;

31) a retaining device on length 22*b* between the second end 25*b* and the pivotal point 34;

32*a*) an aperture on the second arm means 22 between the first end 24 and the pivotal point 34 to which a retaining device 28, 30 can be coupled to or uncoupled from;

32*b*) an aperture on the second arm means 22 between the second end 25 and the pivotal point 34 to which a retaining device 29, 31 can be coupled to or uncoupled from;

34) the pivotal point;

35) the bolt assembly at the pivotal point 34;

36*a–j*) resilient elements.

The device illustrated in FIG. 1 represents a form of the exercising device 10 in accordance with the invention comprised of a pair of arm means 12, 22 restricted in a contracted position by providing that retaining devices 16, 17, 18, 19, 28, 29, 30, 31 on different arm means 12, 22, and on corresponding sides of the pivotal point 34, are interconnected with resilient elements 36*a*, 36*b*, 36*c*, 36*d*. The arm means 12, 22 are pivotally attached at a point intermediate of their ends by an uncouplable bolt assembly 35, and may be made of any lightweight, inflexible material, for example wood, metal, graphite, plastic, etc. Grip assemblies 15, 26 are attached to the first ends 14*a*, 24 of each arm means 12, 22 and provide for gripping the device with the hands or feet.

The first arm means 12 consists of one rigid length 12*a* along both sides of which retaining devices 16, 17, 18, 19 are releasably coupled. At the first end 14*a* a grip assembly 15 with a handle perpendicular to length 12*a* is attached.

The second arm means 22 consists of two rigid lengths 24*a*, 24*b* which are aligned, run parallel and are attached to each other by the coupling of the releasably couplable retaining devices 28, 29, 30, 31 to the second arm means 22. The attachment of length 24*a* to length 24*b*, which will be described later, incorporates a space between them through which the position of length 12*a* is disposed. Retaining devices 28, 29, 30, 31 are releasably coupled along the external sides of lengths 24*a*, 24*b*. At the first end 24 a grip assembly 26 with a handle perpendicular to lengths 24*a*, 24*b* is attached.

The first arm means 12 and the second arm means 22 are releasably coupled to each other at the pivotal point 34 by the bolt assembly 35. Apertures 20*a*, 20*b* are disposed along length 12*a*, and apertures 32*a*, 32*b* are disposed along lengths 22*a*, 22*b*. All apertures 20*a*, 20*b*, 32*a*, 32*b* are the same size and allow that the pivotal point 34 with its bolt assembly 35 can be positioned at any aperture along the three lengths 12*a*, 22*a*, 22*b*, and that the retaining devices 16, 17, 18, 19, 28, 29, 30, 31 can also be so positioned. The purposes related to relocating the retaining devices and the pivotal point 34 about the three lengths 12*a*, 22*a*, 22*b* involve allowing the device an alterable structure that will facilitate both adjustment of the device and an increase to the variety of exercises that can be performed. It is also possible to have a slot system between apertures thereby allowing the retaining devices and the bolt assembly 35 to slide freely between apertures when repositioning them. The details of this slot system will be described later.

When the exercising device is in a contracted position, as illustrated in FIG. 1, it is possible to connect a retaining device, e.g., 18*c* on one side of the pivotal point 34 of the first arm means 12 to a retaining device, e.g., 30*c* on the same side of the pivotal point 34 of the second arm means 22 with a resilient element, e.g. 36*b*. A resilient element attached in this fashion causes resistance to angular movement of the two arm means 12, 22 away from each other because it disposes the two arm means 12, 22 to a force towards each other. There are at least ten separate positions between retaining devices of different arm means 12, 22 wherein a resilient element can be so attached, e.g., between 16*a* and 28*a*, 18*a* and 30*a*, 16*c* and 28*c*, 17 and 29, 19 and 31, etc. allowing up to and between one to twenty or more resilient elements to be used for the purposes of creating and varying degrees of resistance, though when using a form of the invention as illustrated in FIG. 1, one to eight resilient elements is sufficient. Repositioning the pivotal point 34 and/or the retaining devices allows for further varying of the degrees of resistance. Retaining devices 16*a*, 16*b*, 18*a*, 18*b*, 28*a*, 28*b*, 30*a*, 30*b* can be used to interconnect the two arm means 12, 22 however as illustrated in FIG. 1 they are used to retain unused resilient elements 36*g*, 36*h*, 36*i*, 36*j*. With the exercising device 10 in the contracted position, as described above, it is possible for a user to grasp each grip assembly 15, 26 with a hand, at which point resistance to angular movement of the two arm means 12, 22 away from each other is encountered as they are forced in that direction by the user. In the same closed position it is also possible for a user to grasp one of the grip assemblies 15 or 26 with a hand while the other grip assembly is held by the user's foot in a static position on a ground surface. Again resistance to angular movement of the two arm means 12, 22 away from each other is encountered as the user forces the hand held grip assembly up and away from the one held by the foot.

Figure 2:
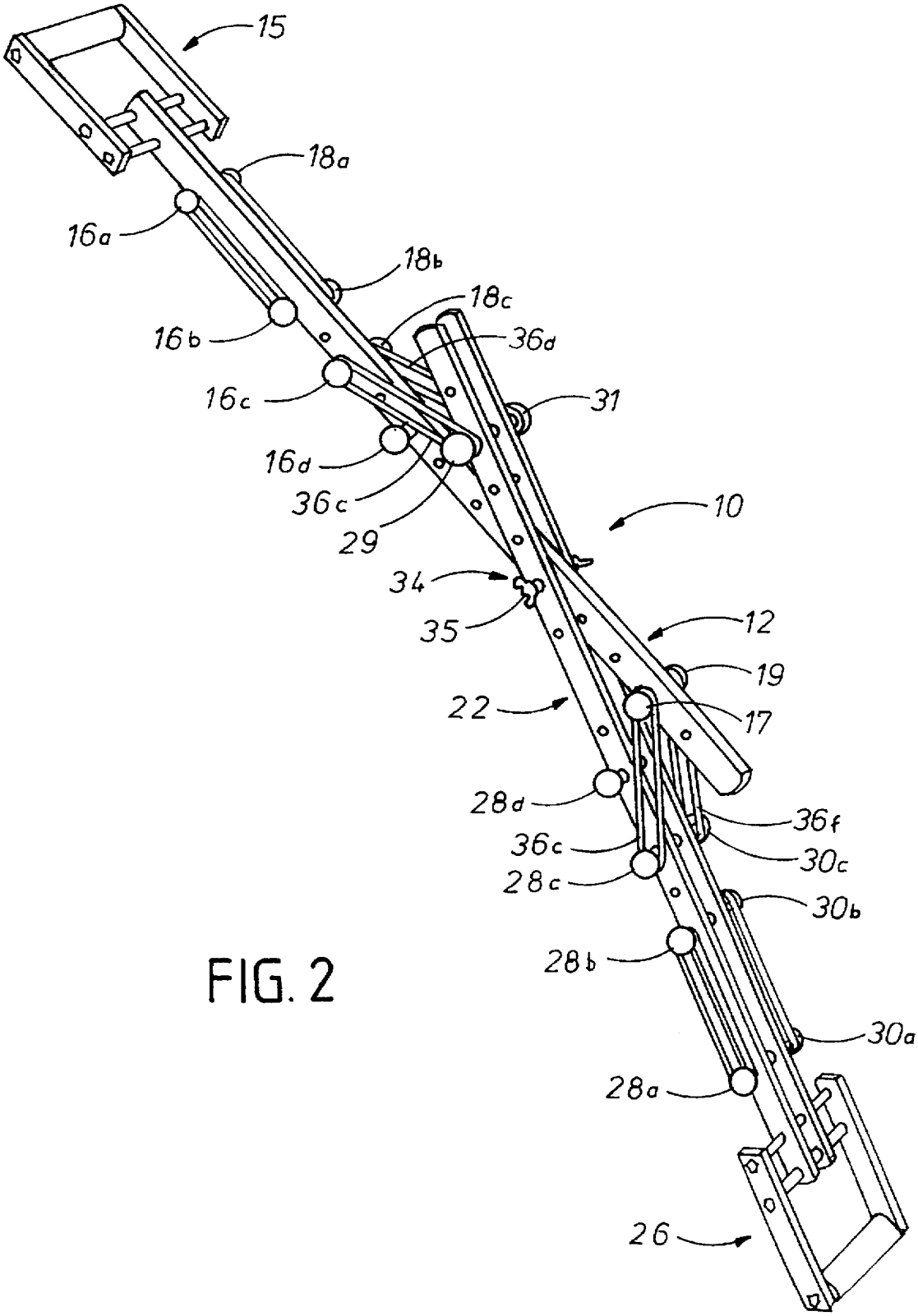
FIG. 2 is a perspective view of the exercising device in an elongated position.

Referring now to FIG. 2 there is a form of the exercising device 10 in accordance with the invention comprised of a pair of arm means 12, 22 restricted in the elongated position by providing that retaining devices 16, 17, 18, 19, 28, 29, 30, 31 of separate arm means 12, 22, and on opposite sides of the pivotal point 34, are interconnected with resilient elements 36*c*, 36*d*, 36*e*, 36*f*.

When the exercising device 10 is in the elongated position, as illustrated in FIG. 2, it is possible to connect a retaining device, e.g., 16*c*, on one side of the pivotal point 34 of the first arm means 12 to a retaining device, e.g., 29, on the other side of the pivotal point 34 of the second arm means 22 with a resilient element, e.g., 36*c*. A resilient element attached in this fashion causes resistance to angular movement of the two arm means 12, 22 towards each other because it disposes the two arm means 12, 22 to a force away from each other. There are at least four separate positions between retaining devices of different arm means 12, 22 wherein a resilient element can be so attached, e.g., between 16*c* and 29, 18*c* and 31, 28*c* and 17, 30*c* and 19, allowing up to and between one and eight, or more, resilient elements to be used for the purposes of creating and varying degrees of resistance. Again, repositioning the pivotal point 34 and/or the retaining devices allows for further varying of the degrees of resistance.

With the exercising device 10 in the elongated position, as described above, it is possible for a user to grasp each grip assembly 15, 26 with a hand, at which point resistance to angular movement of the two arm means 12, 22 towards each other is encountered as they are forced in that direction by the user. In the same open position it is also possible for a user to grasp one of the grip assemblies 15 or 26 with a hand while the other grip assembly is held by the user's foot in a static position on a ground surface. Again resistance to angular movement of the two arm means 12, 22 towards each other is encountered as the user forces the hand held grip assembly down towards the one held by the foot.

Figure 3:
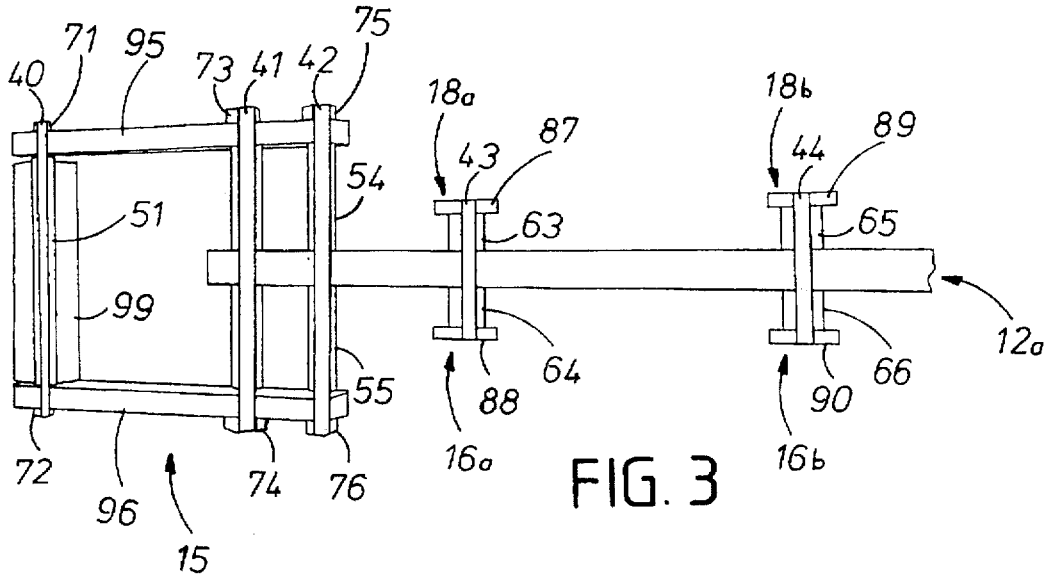
FIG. 3 is an enlarged sectional view of a gripping assembly.

Referring now to FIG. 3 there is shown a detail of the grip assembly 15 and the retaining devices 16*a*, 16*b*, 18*a*, 18*b* attached to length 12*a*. Bolt 40 runs through lengths 95, 96 and collar 51, and is affixed with nuts 71, 72. Collar 51 has a smaller diameter than that of the aperture in handle 99 through which collar 51 runs, allowing handle 99 to spin freely about collar 51. Bolts 41, 42 run through lengths 95, 96 and collars 52, 53, 54, 55, and are affixed with nuts 73, 74, 75, 76. All collars have diameters larger than the apertures in lengths 12*a*, 95, 96 through which the bolts are positioned, thereby maintaining lengths 12*a*, 95, 96 at fixed positions from each other. Bolt 43 runs through length 12*a* and collars 63, 64, and is affixed with retaining discs 87, 88. Bolt 44 runs through length 12*a* and collars 65, 66, and is affixed with retaining discs 89, 90. All retaining discs act as nuts and can be screwed or unscrewed to bolts in the same manner.

Figure 4:
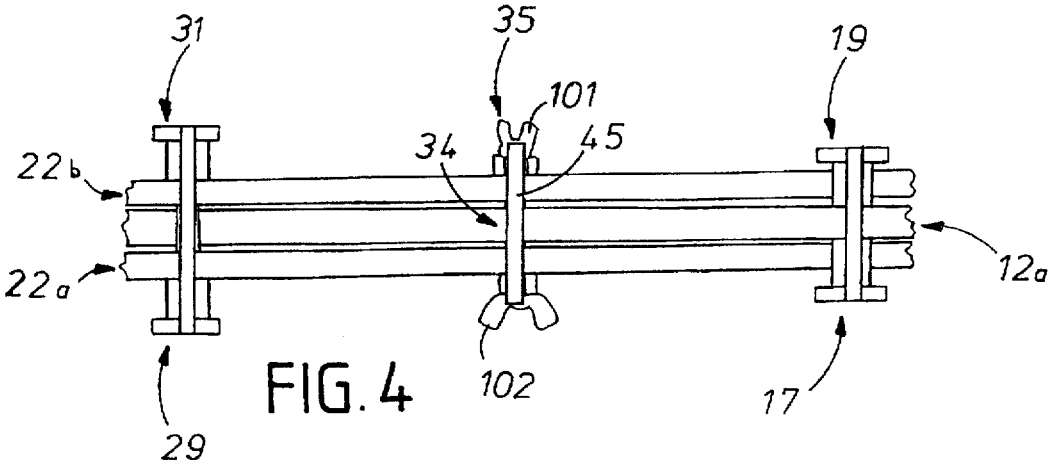
FIG. 4 is an enlarged sectional view of a central portion of the exercising device.

FIG. 4 shows a detail of the bolt assembly 35 at the pivotal point 34. Bolt 45 runs through lengths 12*a*, 22*a*, 22*b* and is affixed with wing nuts 101, 102. To facilitate angular movement of the two arm means 12, 22 washers can be positioned around bolt 45 between length 12*a* and length 22*a* and between length 12*a* and length 22*b*.

Figure 5:
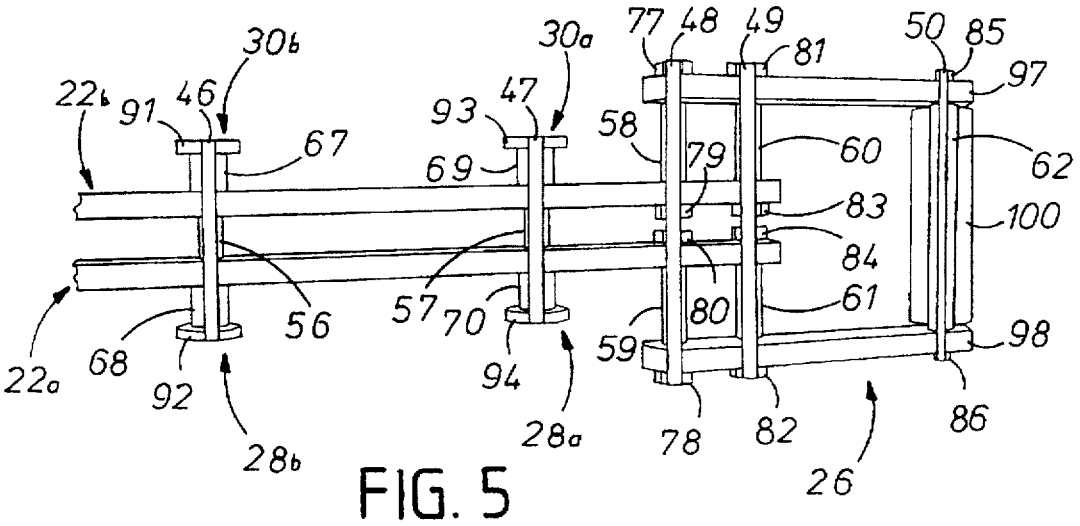
FIG. 5 is an enlarged sectional view of another gripping assembly.

FIG. 5 shows a detail of grip assembly 26 and retaining devices 28*a*, 28*b*, 30*a*, 30*b* attached to lengths 22*a*, 22*b*. Bolt 50 runs through lengths 97, 98 and collar 62, and is affixed with nuts 85, 86. Collar 62 acts in an identical manner to collar 51 allowing handle 100 to spin freely about it. Bolts 48, 49 run through lengths 97, 98, 22*a*, 22*b* and collars 58, 59, 60, 61, and are affixed with nuts 77, 78, 79, 80, 81, 82, 83, 84. Bolt 47 runs through lengths 22*a*, 22*b*, and collars 57, 69, 70, and is affixed with retaining discs 93, 94. Bolt 46 runs through lengths 22*a*, 22*b* and collars 56, 67, 68, and is affixed with retaining discs 91, 92. Again the collars are designed so as to maintain spaces between the lengths. Collars 56 and 57 maintain a distance between lengths 22*a*, 22*b* large enough for length 12*a* to be positioned.

Figure 6:
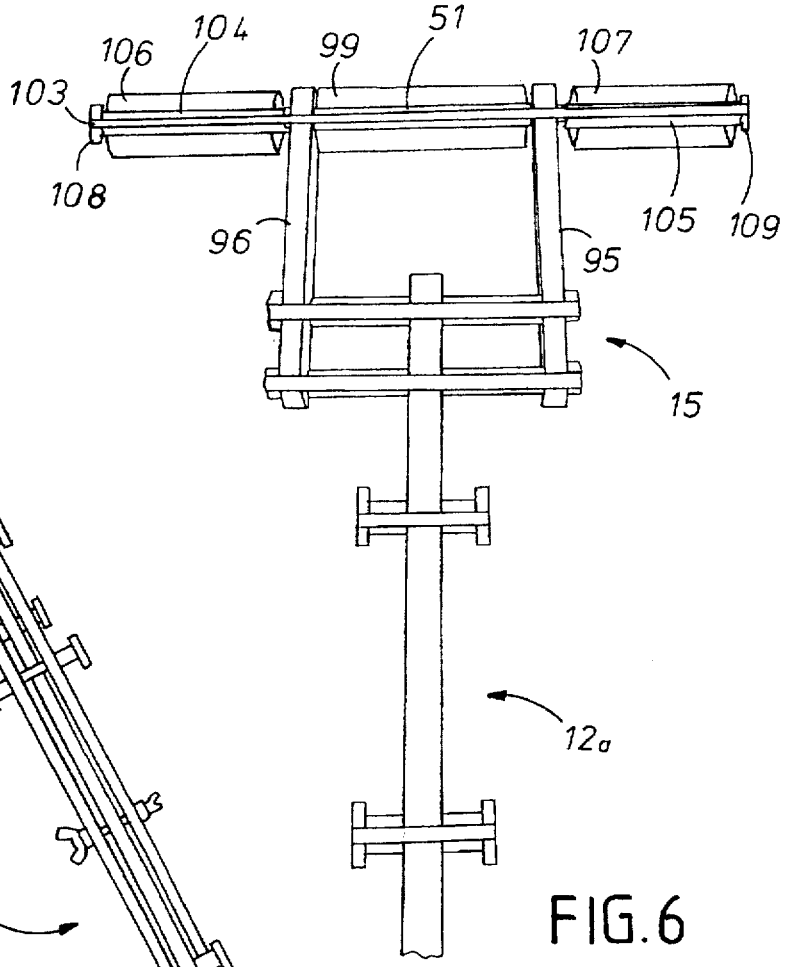
FIG. 6 is also an enlarged sectional view of a gripping assembly.

FIG. 6 shows a detail of grip assembly 15 with a two handle grip. Bolt 103 runs through lengths 95, 96 and collars 51, 104, 105, and is affixed with nuts 108, 109. Collars 104, 105 run through handles 106, 107. Again the collars maintain spaces and allow the handles to spin freely.

Figure 7:
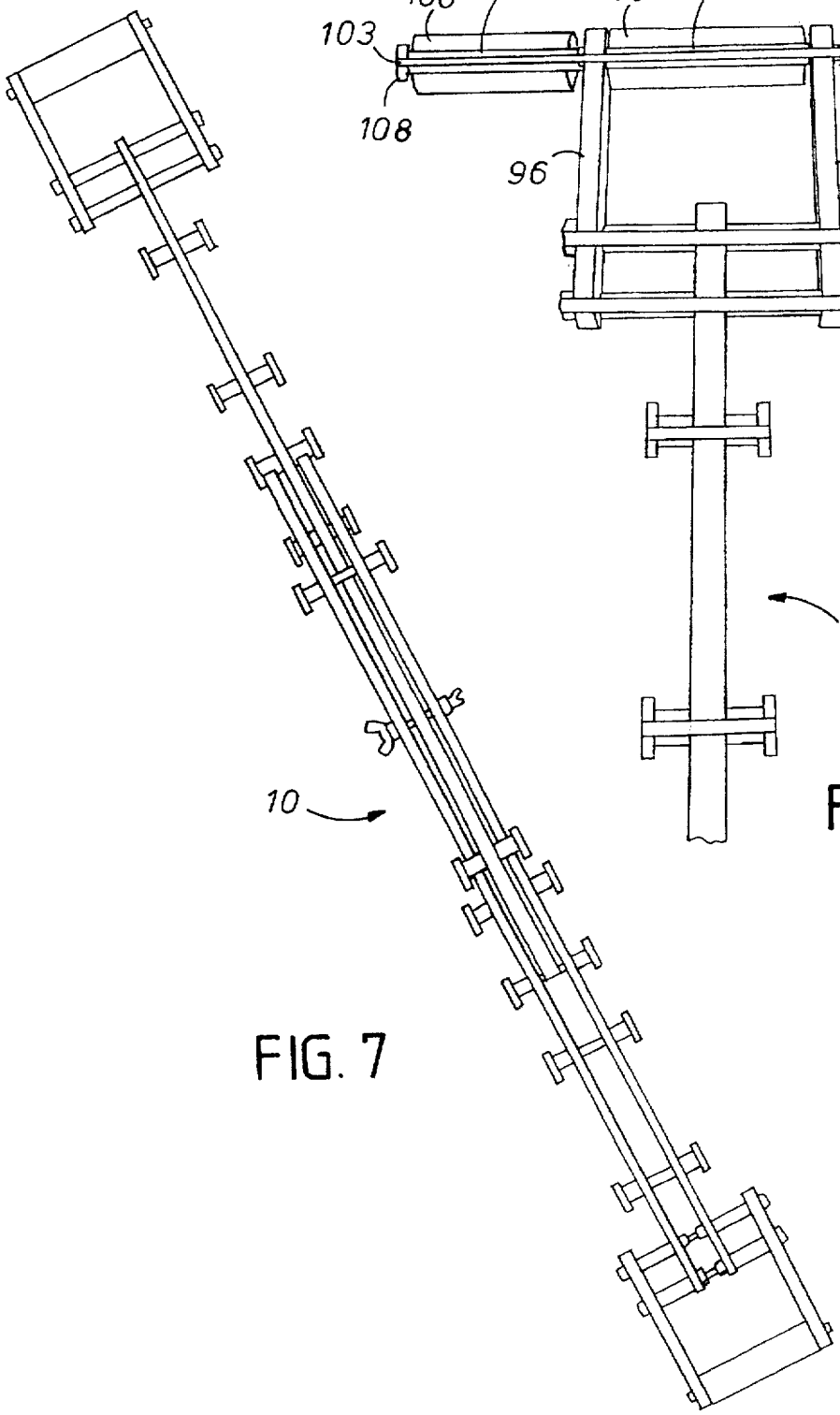
FIG. 7 is an elevational view of the exercising device in the elongated position.

FIG. 7 provides an elevational view of the exercising device in the elongated position for further representation of its construction.

Figure 8:
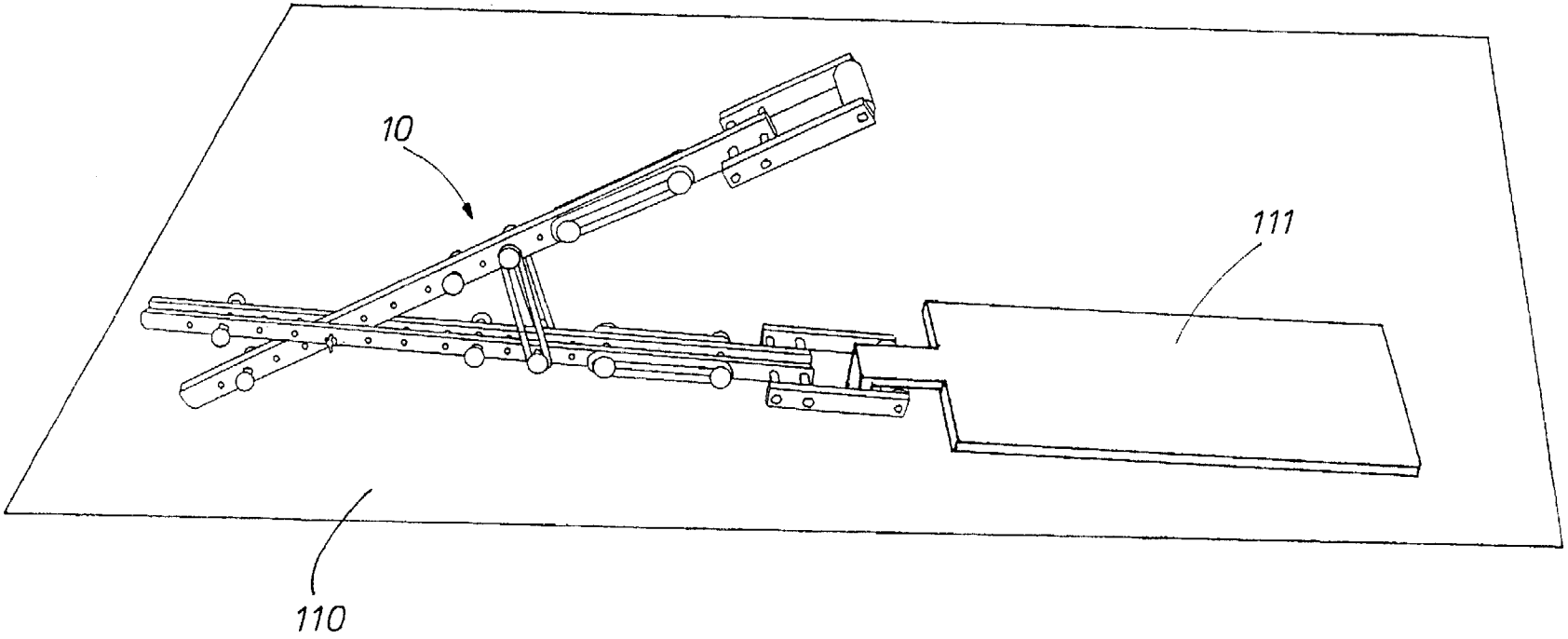
FIG. 8 is a perspective view of the exercising device with a retaining assembly.

FIG. 8 shows the exercising device 10 in the contracted position being held securely on a solid surface 110 by a retaining board 111. The retaining board 111 can be used to secure a grip assembly 15, 26 to a solid surface 110 either by a user standing on the retaining board 111 or by a user lying on it. Use of the retaining board 111 for this purpose allows for further varying the nature of the exercises to be performed.

Figure 9:
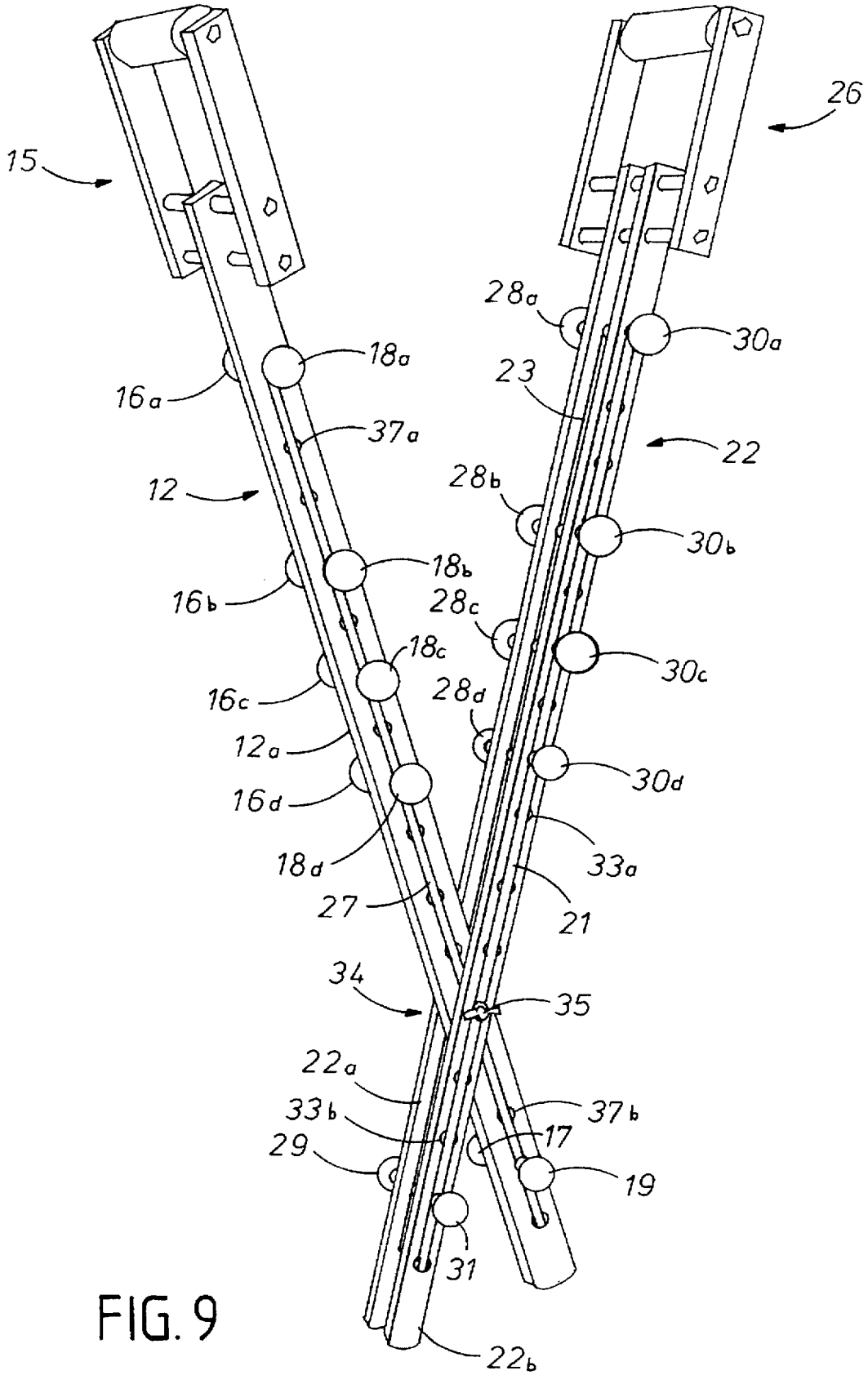
FIG. 9 is a perspective view of the exercising device in the contracted position.

FIG. 9 shows a form of the exercising device in accordance with the invention represented in the contracted position and having slots 21, 23, 27 positioned along lengths 12*a*, 22*a*, 22*b*. Circular grooves 33*a*, 33*b*, 37*a*, 37*b* are disposed concentricly along slots 21, 23, 27 whereat retaining devices 16*a–d*, 17, 18*a–d*, 19, 28*a–d*, 29, 30*a–d*, 31 and the bolt assembly 35 are positionable. Using slots 21, 23, 27 in this fashion allows for the movement and repositioning of the retaining devices and bolt assembly 35 about lengths 12*a*, 22*a*, 22*b* without detachment, and therefore differs from the form of the invention as represented in FIG. 1 whereat detachment of the retaining devices and the bolt assembly 35 is necessary when repositioning them.

Figure 10:
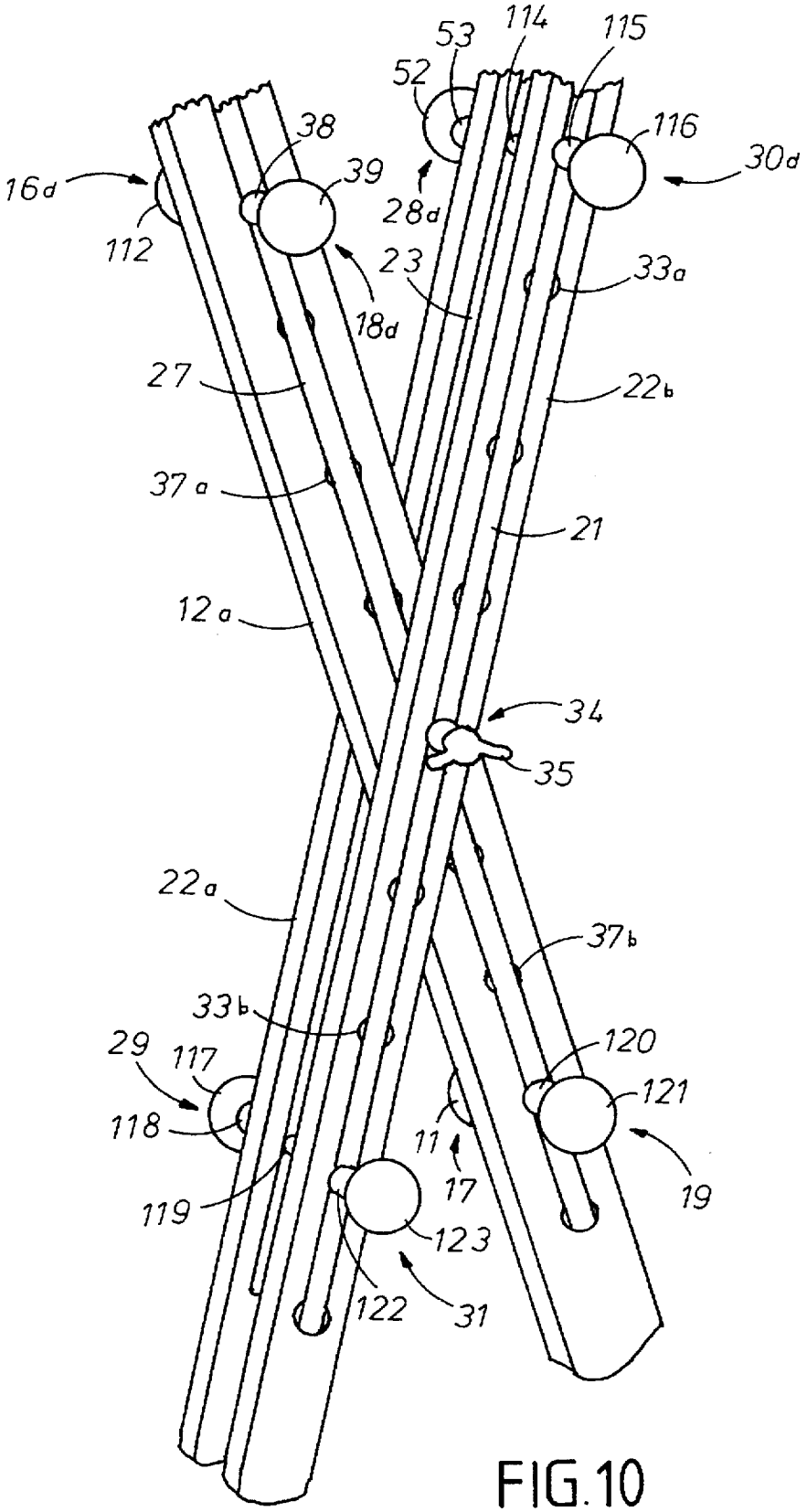
FIG. 10 is an enlarged sectional view of the central and end sections of the exercising device.

FIG. 10 shows a detail of lengths 12*a*, 22*a*, 22*b* with slots 21, 23, 27. A bolt runs through retaining discs 112, 39 and collar 38. A bolt runs through retaining discs 11,121 and collar 120. A bolt runs through retaining discs 52, 116 and collars 53, 114, 115. A bolt runs through retaining discs 117, 123 and collars 118, 119, 122. All bolts have a smaller diameter than the widths of slots 21, 23, 27 and can move freely through them. Collars 38, 53, 115, 118, 120, 122 have a diameter larger than the widths of slots 21, 23, 27 but sufficient to fit tightly into grooves 33*a*, 33*b*, 37*a*, 37*b* and as so positioned keep retaining devices 16*d*, 17, 18*d*, 19, 28*d*, 29, 30*d*, 31 firmly in place. Collars 114, 119 have a diameter larger than the widths of slots 21, 23, 27 and as such maintain a distance between lengths 22*a* and 22*b*. The bolt assembly 35 is also sufficiently formed with nuts to fit securely into any of the grooves 33*a*, 33*b*, 37*a*, 37*b*. To reposition the retaining devices or the bolt assembly 35 requires loosening of these elements until the collars or nuts can be removed from the grooves whereat the retaining devices or bolt assembly 35 can slide freely within the slots 21, 23, 27 and be subsequently refitted and tightened in another groove.

The above description represents one form of the invention and in this capacity is meant to portray the principles and possibility for its embodiment. However within the scope of the invention numerous other embodiments are also possible.

What I claim is:

1. An exercising device comprising first and second rigid arm means with first and second ends, being pivotally connected intermediate their ends, having perpendicular handles attached to ends and a plurality of apertures disposed along their lengths whereat retaining devices and the pivotal point are securely positionable, such that the pivotal point and the retaining devices are relocatable at any of the apertures along the lengths, such that on either side of the pivotal point retaining devices are positioned whereat resilient elements are securable to or removable from, such that retaining devices on different arm means are interconnectable with resilient elements, such that interconnecting retaining devices on different arm means and on corresponding sides of the pivotal point, either between the pivotal point and the first end or between the pivotal point and the second end, with resilient elements causes resistance to angular movement of the two first ends away from each other and the two second ends away from each other, such that interconnecting retaining devices on different arm means and on opposite sides of the pivotal point with resilient elements causes resistance to angular movement of the two first ends towards each other and the two second ends towards each other.

2. An exercising device comprising first and second rigid arm means with first and second ends being pivotally connected intermediate their ends, having perpendicular handles attached to ends and slots with a plurality of concentric grooves disposed along their lengths whereat retaining devices and the pivotal point are securely positionable, such that the pivotal point and the retaining devices are moveable about the dimensions of the slots and are relocatable at any of the concentric grooves along the slots, such that on either side of the pivotal point retaining devices are positioned whereat resilient elements are securable to or removable from, such that retaining devices on different arm means are interconnectable with resilient elements, such that interconnecting retaining devices on different arm means and on corresponding sides of the pivotal point, either between the pivotal point and the first end or between the pivotal point and the second end, with resilient elements causes resistance to angular movement of the two first ends away from each other and the two second ends away from each other, such that interconnecting retaining devices on different arm means and on opposite sides of the pivotal point with resilient elements causes resistance to angular movement of the two first ends towards each other and the two second ends towards each other.

3. An exercising device as set forth in claims 1 and 2 wherein one of the two arm means consists of one rigid length and the other of the two arm means consists of two rigid lengths that are aligned, parallel, spaced from each other, attached to each other, and between which the first arm means is positioned.

4. An exercising device as set forth in claims 1 and 2 wherein one or more elastic or spring devices are used as resilient elements.

5. An exercising device as set forth in claims 1 and 2 wherein the retaining devices are releasably couplable to the arm means and are selectively repositionable about the lengths of each of the arm means.

6. An exercising device as set forth in claims 1 and 2 wherein the first and second arm means are releasably coupled to each other at the pivotal point allowing the pivotal point to be selectively repositioned about the lengths of the two arm means.

7. An exercising device as set forth in claims 1 and 2 wherein single or double hand grips are attached at one or both ends of either of the two arm means.

8. An exercising device as set forth in claims 1 and 2 wherein an end or a gripping device is affixed to a retaining assembly in order to permanently or impermanently secure that end to a solid surface.

* * * * *